US010380989B1

(12) United States Patent
Chen

(10) Patent No.: US 10,380,989 B1
(45) Date of Patent: Aug. 13, 2019

(54) METHODS AND APPARATUS FOR PROCESSING STEREOPHONIC AUDIO CONTENT

(71) Applicant: Cirrus Logic International Semiconductor Ltd., Edinburgh (GB)

(72) Inventor: Henry Chen, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/902,165

(22) Filed: Feb. 22, 2018

(51) Int. Cl.
*G10K 11/175* (2006.01)
*H04S 1/00* (2006.01)
*G10L 25/18* (2013.01)

(52) U.S. Cl.
CPC ..... *G10K 11/175* (2013.01); *G10L 25/18* (2013.01); *H04S 1/002* (2013.01)

(58) Field of Classification Search
CPC ..... G10K 11/175; H04S 1/002; G10L 25/18
See application file for complete search history.

(56) References Cited

U.S. PATENT DOCUMENTS

2018/0192229 A1* 7/2018 Easley ..... H04S 7/307

* cited by examiner

*Primary Examiner* — Ping Lee
(74) *Attorney, Agent, or Firm* — Jackson Walker L.L.P.

(57) ABSTRACT

A method of processing stereophonic audio content received in a first audio channel to be output to a first speaker and a second audio channel to be output to a second speaker, the method comprising: receiving the first and second audio channels; identifying a plurality of frequency sub-bands in the first audio channel; for each of the plurality of frequency sub-bands, determining an importance weighting based on a degree of audibility of the sub-band when combined with the remainder of sub-bands of the first audio channel and the second audio channel; on determining that a peak amplitude of the first audio channel is above a first clipping threshold, iteratively suppressing the sub-band of least importance in the first audio signal until the peak amplitude of the first audio signal is below the first clipping threshold; and outputting the suppressed first audio channel.

60 Claims, 9 Drawing Sheets

METHODS AND APPARATUS FOR PROCESSING STEREOPHONIC AUDIO CONTENT

TECHNICAL FIELD

The present disclosure relates to methods and apparatus for processing stereophonic audio content.

BACKGROUND

Most modern communication devices, especially portable communications devices such mobile or cellular telephones, comprise at least two speakers. Typically there may be a loudspeaker located on the device, e.g. for audio media playback. This loudspeaker may be located towards the bottom of the device. In addition there may be an earpiece receiver speaker (i.e. a second speaker) at a different location on the device, for example towards the top of the device or otherwise at a location near where a user's ear may be expected to be in use (if not using an accessory such as a headset or using the device in a speakerphone mode). FIG. 1 for example illustrates a device 100, which in this example may be a mobile telephone, having a loudspeaker 102 at a first location on the device and also having an earpiece receiver speaker 104 at a different location.

In most common configurations the earpiece speaker and loudspeaker are used for different functions and typically the loudspeaker can generate a much greater sound pressure level (SPL) than the earpiece. The earpiece speaker is typically used as the output device during handset calls, when it is expected that the device is held next to the user's ear. The loudspeaker may be used as the output device during music playback and speakerphone mode calls.

The loudspeaker may typically be of the order of 8 Ohm, and may be driven for example by a 5V-10V boosted D or G class amplifier which is capable of driving around 4 W into the speaker. The earpiece may typically be of the order of 32 Ohm, and may for example be driven by a 2.5V A/B class amplifier which is capable of driving around 100 mW in to the earpiece speaker.

SUMMARY

According a first aspect of the disclosure, there is provided a method of processing stereophonic audio content received in a first audio channel and a second audio channel, the first audio channel to be output to a first speaker and the second audio channel to be output to a second speaker, the method comprising: receiving the first and second audio channels; identifying a plurality of frequency sub-bands in the first audio channel; for each of the plurality of frequency sub-bands, determining an importance weighting based on an estimated degree of audibility of the sub-band in the first audio channel when the first and second audio channels are output to the first and second speakers; in response to determining that a peak amplitude of the first audio channel is above a first clipping threshold, iteratively suppressing the sub-band of least importance in the first audio signal until the peak amplitude of the first audio signal is below the first clipping threshold; and outputting the suppressed first audio channel.

Determining the importance weighting for each of the first plurality of frequency sub-bands may comprise: comparing each sub-band with the remainder of the first audio signal and/or the second audio signal; and determining an amount of auditory masking of the sub-band based on the comparison. In some embodiments, the importance weighting decreases as the level of auditory masking for the sub-band increases.

Determining the importance weighting for each of the first plurality of frequency sub-bands may comprises: comparing an amplitude of each sub-band with an amplitude of a corresponding sub-band in the second audio channel; and increasing the importance weighting if the amplitude of the sub-band in the first audio channel is greater than the amplitude of corresponding sub-band in the second audio channel.

The importance weighting may be determined based on an estimated sensitivity of a human ear in the frequency range of the sub-band. In some embodiments, the sensitivity of the human ear is estimated using an ITU-R 468 noise weighting curve, an inverse equal-loudness contour, or an A-weighting curve.

Additionally or alternatively, the importance weighting may be determined based on a frequency response of the first speaker in the frequency range of the sub-band. In some embodiments, the importance weighting is determined based on the difference in frequency response between the first speaker and the second speaker in the frequency range of the sub-band. For example, the importance weighting may be determined based on a speaker efficiency index Wm defined by:

$$Wm=(1/1+b^2);\ b=FR_{SP2}/FR_{SP1}$$

where $FR_{SP1}$ is the frequency response of the first speaker and $FR_{SP2}$ is the frequency response of the second speaker.

The plurality of frequency sub-bands in the first audio channel may be identified using the Bark scale.

The method may further comprise: before determining that the peak amplitude of the first audio channel is above the first clipping threshold, equalising the first audio channel based on the frequency response of the first speaker.

The method may further comprise equalising the second audio channel based on the frequency response of the second speaker.

The method may further comprise soft clipping the suppressed first audio channel, for example using a Sigmoid function. After soft clipping, the first audio channel may undergo noise reduction by applying a noise reduction algorithm to the first audio channel to remove artefacts generated by the soft clipping. In some embodiments, the noise reduction algorithm comprises a wiener filter.

Soft clipping may comprise receiving an audio sample of the suppressed first audio channel; on determining that a peak amplitude of the audio sample falls outside a threshold range: suppressing the audio sample to within the threshold range by applying a strictly increasing non-linear function to the audio sample; and outputting the suppressed audio sample; and on determining that the peak amplitude of the audio sample falls within the threshold range or is equal to an upper or lower limit of the threshold range: outputting the received audio sample.

The level of suppression of the audio sample may be proportional to the difference between the peak amplitude of the audio sample and the upper or lower limit of the threshold range.

The strictly increasing non-linear function may be smooth within the threshold range.

Suppression of the audio sample may comprise reducing the peak amplitude to within 0.95 times the threshold range.

Determining that a peak amplitude of the audio sample falls outside of the threshold range may comprise: determining a suppression factor $\alpha$ proportional to the peak amplitude of the audio sample, wherein the non-linear function is weighted by the suppression factor.

A delay may be provided between determining the suppression factor and suppressing the audio sample.

On determining that a peak amplitude of the audio sample falls outside a threshold range, the suppression factor α may be defined by the equation:

$$\alpha = \frac{T - T * f(P)}{P - T * f(P)}$$

where:

P is the peak amplitude of the audio sample;

$f$(P) is the non-linear function solved for the peak amplitude P; and

T is the upper limit of the threshold range.

On determining that the peak amplitude of the audio sample falls within the threshold range or is equal to an upper or lower limit of the threshold range, the suppression factor α may be equal to 1.

The relationship between the received audio sample in and the output suppressed audio sample or the output received audio signal out may be defined as:

$$out = \alpha \cdot in + f(in) \cdot (1 - \alpha)$$

where:

out is the output suppressed audio signal or the output received audio signal;

in is the received audio signal; and $f$(in) is the non-linear function.

The non-linear function $f$(in) may comprise a Sigmoid function.

The non-linear function $f$(in) may comprise a function defined by the equation:

$$f(in) = \mathrm{erf}\left(\frac{\sqrt[2]{\pi}}{2} in\right)$$

where in is the received audio sample.

The non-linear function may be a polynomial function.

Since both the input signal and the output signal are available, the method may further comprise applying a Wiener filter or other noise cancelling function to the suppressed audio sample.

The method may further comprise iteratively repeating the steps listed above for soft clipping for the remainder of audio samples in the suppressed first audio channel.

The method may further comprising: adding suppressed sub-bands in the first audio channel to the second audio channel. The suppressed sub-bands in the first audio channel may be iteratively added to the second audio channel in order of importance (most important to least important) based on the importance weighting until a peak amplitude of the second audio channel exceeds a second clipping threshold. The method may further comprise soft clipping the second audio channel.

According to a second aspect of the disclosure, there is provided an apparatus for processing stereophonic audio content received in a first audio channel to be output to a first speaker and a second audio channel to be output to a second speaker, the apparatus comprising: an input for receiving the first and second audio channels; and one or more processors configured to: identify a plurality of frequency sub-bands in the first audio channel; for each of the plurality of frequency sub-bands, determine an importance weighting based on a degree of audibility of the sub-band when combined with the remainder of sub-bands of the first audio channel and the second audio channel; on determining that a peak amplitude of the first audio channel is above a first clipping threshold, iteratively suppress the sub-band of least importance in the first audio signal until the peak amplitude of the first audio signal is below the first clipping threshold; and an output for outputting the suppressed first audio channel.

Determining the importance weighting for each of the first plurality of frequency sub-bands may comprise: comparing each sub-band with the remainder of the first audio signal and/or the second audio signal; and determining an amount of auditory masking of the sub-band based on the comparison.

The importance weighting may decreases as the level of auditory masking for the sub-band increases.

Determining the importance weighting for each of the first plurality of frequency sub-bands may comprise: comparing an amplitude of each sub-band with an amplitude of a corresponding sub-band in the second audio channel; and increasing the importance weighting if the amplitude of the sub-band in the first audio channel is greater than the amplitude of corresponding sub-band in the second audio channel.

The importance weighting may be determined based on an estimated sensitivity of a human ear in the frequency range of the sub-band. The sensitivity of the human ear may be estimated using an ITU-R 468 noise weighting curve, an inverse equal-loudness contour, or an A-weighting curve.

Additionally or alternatively, the importance weighting may be determined based on a frequency response of the first speaker in the frequency range of the sub-band. In some embodiments, the importance weighting may be determined based on the difference in frequency response between the first speaker and the second speaker in the frequency range of the sub-band. For example, the importance weighting may be determined based on a speaker efficiency index Wm defined by:

$$Wm = (1/1 + b^2);\ b = FR_{SP2}/FR_{SP1}$$

where $FR_{SP1}$ is the frequency response of the first speaker and $FR_{SP2}$ is the frequency response of the second speaker.

The plurality of frequency sub-bands may be identified using the Bark scale.

The one or more processors may be further configured to: before determining that the peak amplitude of the first audio channel is above the first clipping threshold, equalise the first audio channel based on the frequency response of the first speaker.

The one or more processors may be further configured to: equalise the second audio channel based on the frequency response of the second speaker.

The one or more processors may be further configured to soft clip the suppressed first audio channel, for example using a Sigmoid function.

The one or more processors may be further configured to: applying a noise reduction algorithm first audio channel after soft clipping to remove artefacts generated by the soft clipping. The noise reduction algorithm may comprise a wiener filter.

The one or more processors may be further configured to: add suppressed sub-bands in the first audio channel to the second audio channel. The suppressed sub-bands in the first audio channel may be iteratively added in order of importance based on the importance weighting until a peak amplitude of the second audio channel exceeds a second clipping threshold.

The one or more processors may be further configured to soft clip the second audio channel.

According to another aspect of the disclosure, there provided an electronic device comprising an apparatus as described above. The electronic device may be: a mobile phone, for example a smartphone; a media playback device, for example an audio player; or a mobile computing platform, for example a laptop or tablet computer.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

By way of example only, embodiments are now described with reference to the accompanying drawings, in which.

DESCRIPTION OF EMBODIMENTS

Figure 1:
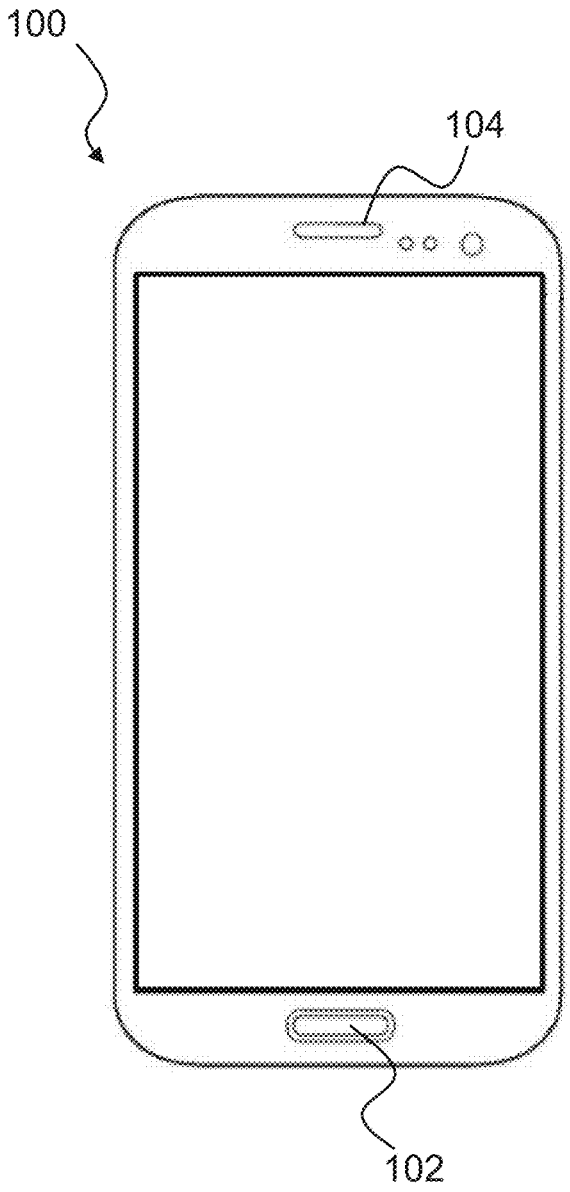
FIG. 1 is an illustration of a mobile communications device.

Embodiments of the present disclosure relate to methods and apparatus for processing stereophonic (or stereo) audio for output to two or more speakers of a mobile device, such as the earpiece receiver speaker used for audio output during handset calls and a device loudspeaker typically used for media playback. The two speakers are typically unmatched in that they generate significantly different sound pressure levels (SPLs) and/or in that they have a mismatched or unmatched frequency response.

An unmatched frequency response of the two speakers poses a challenge to stereo playback, particularly where the frequency response of the earpiece speaker and device loudspeaker differ significantly. The device loudspeaker is typically more sensitive, and will typically have a larger back cavity volume and be driven by a higher drive voltage compared to the smaller earpiece speaker. Additionally, the loudspeaker is sometimes not ported to the front of the device, e.g. the mobile phone, and may instead by side ported. For a user who is looking at the front of the device, e.g. the screen, side porting of the device loudspeaker may result in significant high frequency (HF) roll off.

The combined effect is that for low frequencies (say <1 kHz) the loudspeaker has significantly greater response than the earpiece speaker whereas at higher frequencies (say >4 Khz) the earpiece speaker may dominate over the loudspeaker.

One technique to account for the difference in sensitivity between the earpiece speaker and loudspeaker is to drive the earpiece speaker with large amounts of gain to match the SPL of the earpiece speaker with that of the loudspeaker. However, driving the earpiece speaker at such high gain levels leads to clipping in the earpiece speaker channel. This effect is exacerbated since the earpiece speaker is typically driven with a lower voltage amplifier than that driving the loudspeaker.

Clipping can be reduced by using a high voltage boost amplifier. However, this can leads to an increase in earpiece coil temperature which in turn leads to a reduction in gain on the earpiece channel, causing the stereo centre to pull towards the dominant loudspeaker of the device.

Embodiments of the present disclosure utilise an algorithm, for instance a digital signal processing (DSP) algorithm, to overcome issues associated with unmatched speakers.

Embodiments relate to signal processing modules for processing audio data as well as methods for processing audio data.

Particular embodiments relate to methods in which frequency sub-bands in one channel of a stereo audio pair are iteratively suppressed to reduce the overall peak-amplitude of that channel so that clipping in the final stereo output, when amplified, is reduced or substantially eliminated. The order in which sub-bands in the audio channel are suppressed may be determined based on the importance of each sub-band in the channel, which itself may be determined based on a degree of audibility of the sub-band when the sub-band is output to a speaker at the same time as the remaining sub-bands making up the two audio channels of the stereo audio pair.

In some embodiments, sub-band suppression is performed primarily on the channel to be output to a speaker in a stereo pair which is less dominant, for example a speaker which has a greater impedance and/or has a lower power rating than the other speaker in the stereo pair. With reference to the mobile device 100 shown in FIG. 1, the less dominant speaker is usually the earpiece speaker 104.

Figure 2:
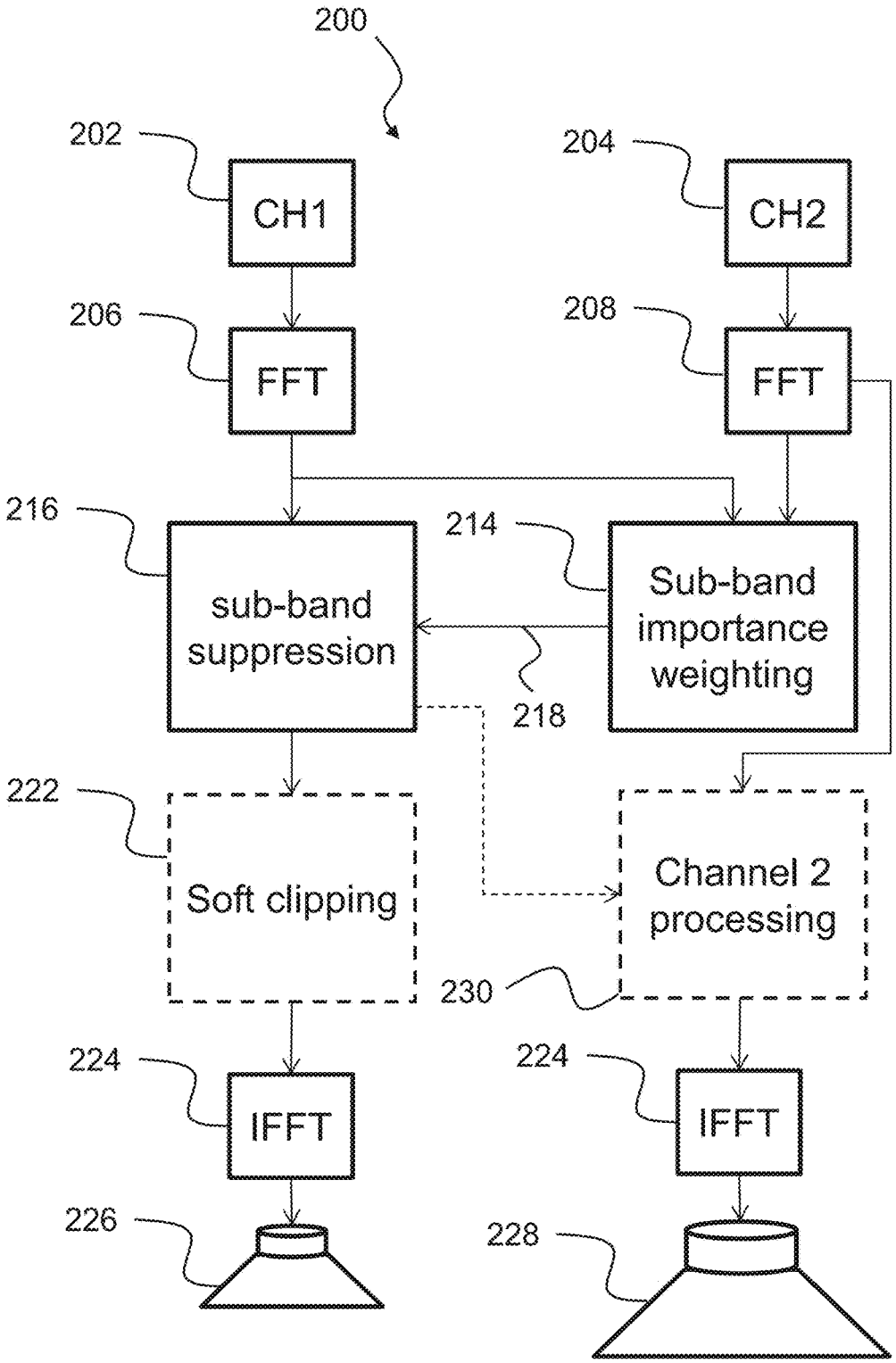
FIG. 2 is a schematic illustration of an apparatus according to various embodiments of the present disclosure.

FIG. 2 illustrates an example of how first and second (left and right) stereo audio channels may be processed according to embodiments of the present disclosure in terms of functional units or modules of a signal processing module 200.

It is noted that the term 'module' shall be used herein to refer to a functional unit or module which may be implemented at least partly by dedicated hardware components such as custom defined circuitry and/or at least partly be implemented by one or more software processors or appropriate code running on a suitable general purpose processor or the like. A module may itself comprise other modules or functional units.

Referring to the signal processing module 200 shown in FIG. 2, first and second audio channels 202, 204 are converted into the frequency domain, for example using first and second fast Fourier transform (FFT) modules 206, 208. Data in the first channel 202 may be destined for output at an earpiece speaker of a communications device, such as the earpiece speaker 104 of the device 100 shown in FIG. 1. Data in the second channel 204 may be destined for output at a loudspeaker of a communications device, such as the loudspeaker 102 of the device 100 shown in FIG. 1.

The first and second audio channels 202, 204 each comprise a plurality of frequency bins. The frequency bins may be grouped into a plurality of sub-bands by the first and second FFT modules 206, 208. Such grouping may be performed, for example, in Bark scale.

The first and second stereo audio channels 202, 204, having been converted into the frequency domain are input to a sub-band importance weighting module 214. The sub-band importance weighting module 214 is configured to determine an importance weighting of each sub-band in the first audio channel based on one or more weighting factors as will be described in more detail below with reference to FIG. 3.

The first audio channel 202 (in the frequency domain) is also input to a sub-band suppression module 216 configured to suppress (e.g. reduce by level or amplitude) one or more sub-bands of the first audio channel in dependence of the one or more importance weightings determined by the sub-band importance weighting module 214, as will be described in more detail below with reference to FIG. 3. To do so, the sub-band suppression module 216 may be configured to receive data, such as importance weighting data, from the sub-band importance weighting module 214 as depicted by arrow 218 in FIG. 2.

The sub-band suppression module 216 is further configured to output a suppressed version of the first audio channel 202, optionally via a soft clipping module 222 to an inverse fast Fourier transform (IFFT) module 224 for conversion from the frequency domain to the time domain. The first channel 202 is then output from the IFFT module 224 to a first speaker 226, such as the earpiece speaker 104 of a mobile device 100 shown in FIG. 1.

The second audio channel 204, having been converted into the frequency domain, is output to a second speaker 228, such as the loudspeaker 102 of the mobile device 100 of FIG. 1, via a channel 2 processing module 230. In some embodiments, the channel 2 processing module 230 may be omitted and the second audio channel 204 in the time domain may be output directly to the second speaker 228, optionally, via a delay module (not shown).

Figure 3:
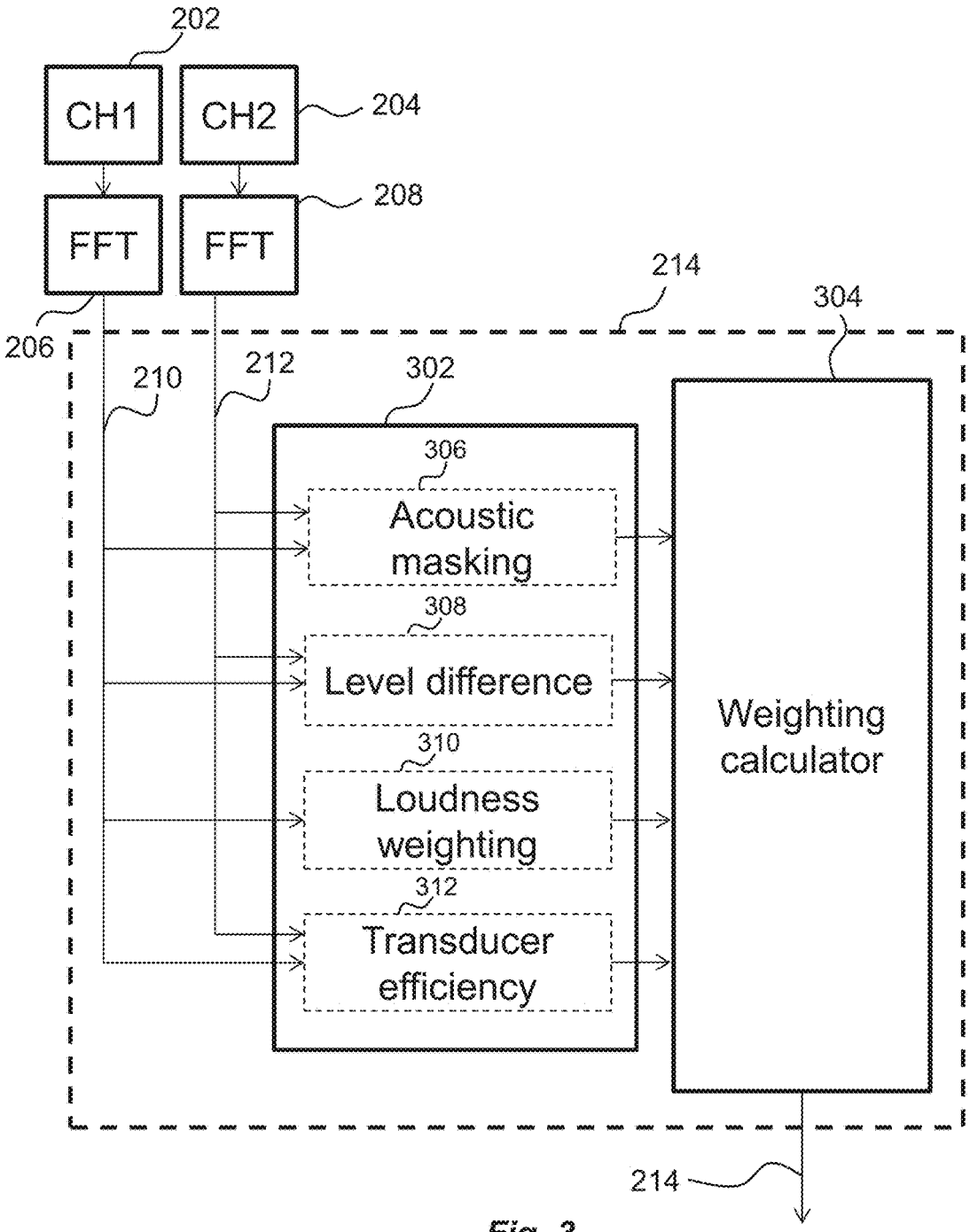
FIG. 3 is a schematic illustration of the sub-band importance weighting module shown in FIG. 2.

The sub-band importance weighting module 214 is shown in FIG. 3 in more detail and comprises a weighting factor module 302 and a weighting calculator 304. As mentioned above, the sub-band importance weighting module 214 is configured to determine an importance weighting for sub-bands in the first channel 202 taking into account the content of at least the first channel 202 and preferably the second channel 204.

For each sub-band in the first channel 202, an importance weighting is determined based on one or more factors which may affect the apparent audibility (or lack thereof) of that sub-band in the final stereo output. The weighting factor module 302 may be configured to determine how each of a plurality of factors affect (positively or negatively) the audibility of each sub-band in the final stereo output. Factors which may affect the audibility of a given sub-band include but are not limited to psycho-acoustic masking 306, level difference 308, relative loudness 310 and transducer efficiency 312, the relevance of which will be described in more detail below. The weighting factor module 302 may determine the level of audibility of the signal based on one, some, or all of these factors. Additionally or alternatively, other factors affecting audibility of the sub-band may be determined by the weighting factor module 302 and used by the weighting calculator to determine importance weightings for each sub-band in the first channel 202.

Psycho-Acoustic Masking

The weighting factor module 302 may determine a level of psycho-acoustic masking 306 of each sub-band in the stereo output. For example, for each sub-band, the weighting factor module 302 may determine whether or not that sub-band will be audible in the final stereo output or whether the sub-band will be masked by the remainder of the first channel 202 and the second channel 204 and therefore inaudible. If the weighting factor module 302 determines that the sub-band will not be audible, then the weighting calculator 304 may give the sub-band a lower rating since the absence of that sub-band would have substantially no impact on the final stereo output and can therefore be suppressed in the first channel 202 with substantially no adverse effect to the final stereo output.

Level Difference

The weighting factor module 302 may additionally or alternatively determine the level difference 308 between the sub-band of interest (e.g. the sub-band for which the importance weighting is being calculated) and a sub-band having the same frequency range in the second audio channel 204. The result may then be output to the weighting calculator 304. If the level of the sub-band of interest is greater than that of the corresponding sub-band in the second audio channel 204, then the weighting calculator 304 may increase the weighting of the sub-band of interest since any signal in the first channel 202 which has a higher level than the corresponding signal in the second channel 204 is preferably preserved for stereo effect.

Relative Loudness

The human ear does not have a flat sensitivity to sound, typically being most sensitive between 3 kHz and 6 kHz, and less sensitive to very low frequency sound and very high frequency sound. Accordingly, the weighting factor module 302 may determine a loudness factor 310 based on an estimated sensitivity of a human ear in the frequency range of the sub-band of interest. For example, the weighting factor module 302 may determine the loudness factor 310 by applying a known sensitivity curve for the human ear to the level of the sub-band of interest. Alternatively, the weighting factor module 302 may determine a loudness factor 310 using only the known sensitivity curve (since the weighting curve is static and therefore independent of sub-band level). Example sensitivity curves known in the art include an ITU-R 468 noise weighting curve, an inverse equal-loudness contour, and an A-weighting curve.

Transducer Efficiency

The weighting factor module 302 may determine a transducer efficiency factor 312 based on the efficiency of the transducer of the first speaker 226 and/or the second speaker 228. For example, the weighting factor module 302 may determine a transducer efficiency index $W_m$ based on the relative frequency response of the first and second speakers 226, 228. In some embodiments, the transducer efficiency index $W_m$ is calculated using on the following equation:

$$W_m=(1/1+b^2);\ b=FR_{SP2}/FR_{SP1};$$

where $FR_{SP1}$ is the frequency response of the first speaker 226 in the frequency range of the sub-band of interest and $FR_{SP2}$ is the frequency response of the second speaker 228 in the frequency range of the sub-band of interest. If the second speaker 228 is much more efficient than that first speaker 226 in the frequency range of interest, then b will be large and the transducer efficiency index $W_m$ will be very small. If the second speaker 228 is much less efficient than that first speaker 226 in the frequency range of interest, then b will be small and the transducer efficiency index $W_m$ will be large. If the first and second speakers 226, 228 have an equal efficiency in the frequency range of interest, then the transducer efficiency index $W_m$ will be equal to ½ or 0.5. The transducer efficiency factor 312 may then be determined based on the transducer efficiency index $W_m$. In some embodiments, the transducer efficiency factor 312 is equal to the transducer efficiency index $W_m$. In any case, the weighting given to each sub-band by the importance weighting calculator 304 may be directly proportional to the transducer efficiency index $W_m$. In other words, the higher the transducer efficiency index $W_m$ for a given sub-band, the higher the weighting that may be given to that sub-band.

As mentioned above, the weighting factor module 302 may determine one, some or all of the factors 306, 308, 310, 312. In some embodiments, the weighting factor module 302 may determine one or more of the factors 306, 308, 310, 312 based on the result of determining others of the one or more factors 306, 308, 310, 312. For example, if the weighting factor module 302 determines that the sub-band of interest will be inaudible due to psycho-acoustic masking 306, then the weighting factor module 302 may output this result to the weighting calculator 304 and perform no further calculations in respect of the other weighting factors 308, 310, 312.

The weighting calculator 304 may utilise information generated by weighting factor module 302 to determine the importance weighting for each sub-band and output the importance weighting(s) to the sub-band suppression module 216.

Some weighting factors may be given more weight than others when determining the importance weighting. For example, the relative weight given to each factor may be determined based on how the audio pair is to be output. The relatively orientation of the first speaker 226 and the second speaker 228 may affect the relative weight given to each factor. For example, taking the device 100 of FIG. 1, if the device 100 is being held by the user to watch a movie or listen to music with the earpiece speaker 104 and the loudspeaker 102 substantially aligned in a horizontal axis, priority may be given to the stereo image. In contrast, when the device 100 is rested on a table top or the like on its rear face, priority may be given to overall loudness. Accordingly, different weights may be given to each factor depending on the orientation and use of the device. To do so, the sub-band importance weighting module 214 may receive data from one or more orientation sensors associated with the device into which the speakers 226, 228 are integrated and determine the importance weightings of each sub-band in the first channel 202 based on the orientation data.

Turning again to FIG. 2, based on the importance weightings calculated by the sub-band importance weighting module, the sub-band suppression module 216 is configured to iteratively suppress sub-bands in the first channel 202 in order of least importance until the peak amplitude of the first channel 202 is below a threshold amplitude.

Figure 4:
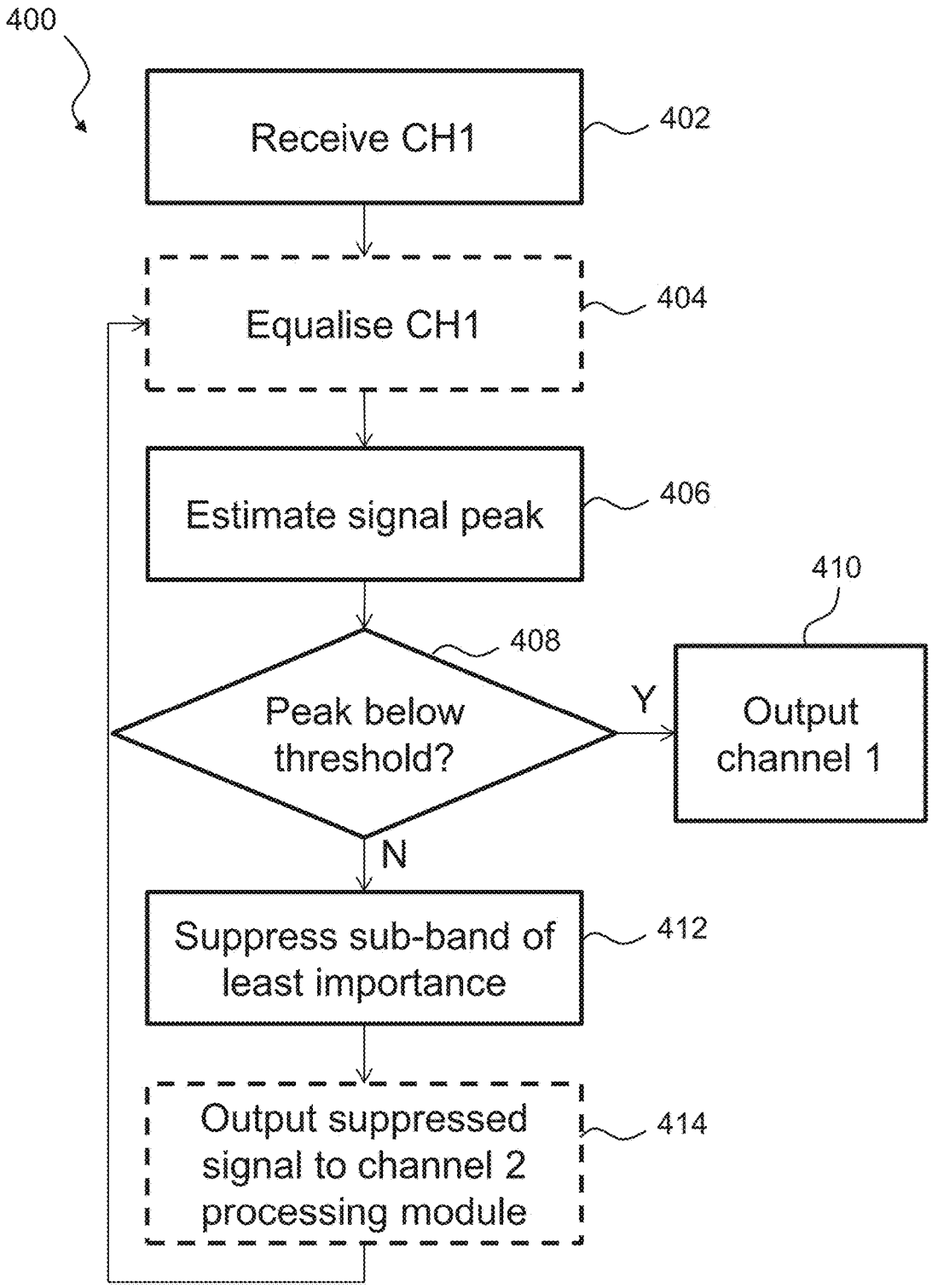
FIG. 4 is a flow diagram of a process performed by the sub-band suppression module shown in FIG. 2.

FIG. 4 is a flow diagram illustrating an exemplary process 400 undertaken by the sub-band suppression module 216 for suppressing sub-bands in the first channel 202. At step 402, the suppression module 216 receives the first channel 202. Optionally, at step 404, the first channel 202 is equalised to take into account the frequency response of the first speaker 226 to which the first channel 202 is to be output. Equalisation at step 404 may also adjust the levels of the first channel 202 to match the loudness of the output at the first speaker 226 with that at the second speaker 228. This is preferable when the first and second speakers 226, 228 have substantially different frequency responses, which is often the case for an earpiece speaker and loudspeaker of a mobile device, such as the device 100 shown in FIG. 1.

Figure 5:
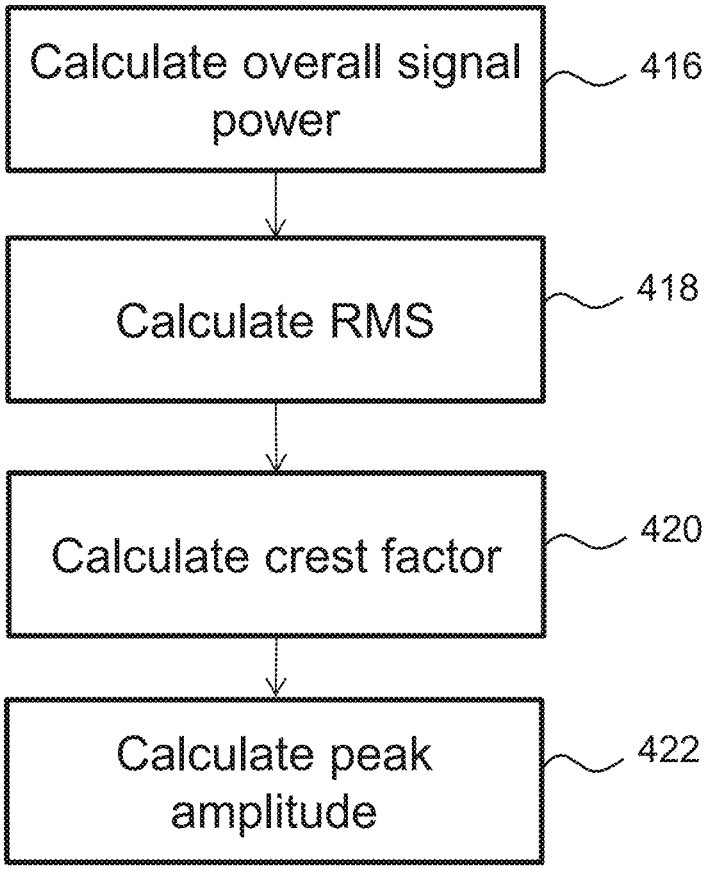
FIG. 5 is a flow diagram showing a process for calculating the peak amplitude of audio samples in the first channel shown in FIG. 2.

After the first channel 202 has been equalised, at step 406, an estimated peak amplitude of the first channel 202 is calculated. The estimated peak amplitude may be determined using Parseval's theorem, from which it can be derived that the time domain energy of a signal post IFFT can be calculated from the signal's Fourier transform before IFFT processing. An example process for estimating peak amplitude of the first channel 202 is shown in FIG. 5. At step 416, the overall signal power of the first channel 202 is calculated by summing the power of each sub-band in the first channel 202. The root-mean-square (RMS) value of the first channel 202 is then calculated at step 418. At step 420 the crest factor G of the first channel 202 is determined. As is known in the art, the crest factor is the ratio of peak signal value to RMS value.

It will be appreciated that direct use of the above ratio may introduce error in the determined crest factor due to the effect of windowing associated with IFFT and the fact that the crest factor is determined based on the shape of the spectrum of the first signal.

However, the inventors have realised that since the crest factor changes slowly over time relative to the frame rate used for sampling, a leaky integrator may be used to more accurately determine the crest factor. An example pseudo-code implementation of such a leaky integrator for tracking of the crest factor G is as follows:

$$G=G+\text{alpha}*(\text{Peak}_{real}-\text{Peak}_{estimated})/\text{signal_RMS}$$

where alpha is a time constant for controlling the speed of tracking, G is the crest factor, $\text{Peak}_{real}$ is the real (measured) peak amplitude, and signal_RMS is the RMS value calculated at step 418. $\text{Peak}_{estimated}$ is the estimated peak amplitude, which may be determined using the following equation:

$$\text{Peak}_{estimated}=G*\text{signal_RMS}(D)$$

where D is the delay between the time at which the peak is estimated and the time at which the peak is measured. The delay D is dependent on the frame rate and the method in which the time domain signal is synthesized (e.g. using filter synthesis, overlap add, etc.).

Having calculated the crest factor, G, the peak amplitude is then calculated at step 422 by multiplying the crest factor and the RMS value calculated at step 418 and 420 respectfully.

Referring again to FIG. 4, the estimated peak amplitude calculated at step 406 is then compared to a peak threshold value at step 408. The peak threshold value may be set to maximise loudness of the first channel 202 when output to the first speaker 226 whilst also reducing instances of harmonic distortion introduced by subsequent processing blocks, such as the soft clipping module 222, if used.

If it is found at step 408 that the estimated signal peak is equal to or below the peak threshold value, then at step 410 the first channel 202 may be output without any modification (i.e. with no sub-band suppression).

If it is found at step 408 that the estimated signal peak is above the peak threshold value, then at step 412 the sub-band suppression module 216 may suppress the sub-band of least importance based on sub-band importance weightings calculated by and received from the sub-band importance weighting module 214. After sub-band suppression at step 412, the process 400 may then return to step 404, where the first channel 202, this time having one or more sub-bands suppressed is equalised and at step 406 the calculation of signal peak of the first channel 202, is repeated. Steps 408, 412, 414, 404 and 406 are then repeated until the estimated signal peak of the first channel is equal to or falls below the peak threshold value when the suppressed first channel is output at step 410 to the soft clipping module 222.

Optionally, the suppressed sub-band signal which was removed from the first channel 202 at step 412 may be output to the channel 2 processing module 230 at step 414 for further processing, as discussed below in more detail.

Suppression of the sub-band of least importance may comprise complete removal of the sub-band, for example using masking, or alternatively the amplitude of the sub-band may be reduced by a predetermined amount. The predetermined amount of reduction of amplitude of the sub-band of least importance may be determined based on the difference between the previously estimated signal peak of the first channel and the peak threshold value. For example, if the estimated signal peak surpasses the peak threshold value by a small amount, the amplitude of the sub-band of least importance may be reduced at step 412 by an amount required to bring the estimated signal peak to equal or just below the peak threshold value. If, however, the peak threshold value exceeds the estimated signal peak by a large amount, the sub-band of least importance may be completely removed or multiple sub-bands of least importance may be removed simultaneously.

Referring again to FIG. 2, the first channel 202 having been processed by the sub-band suppression module 216 may be provided to the soft clipping module 222. Since the signal peak of the first channel 202 is estimated and not measured, instances may exist where the amplitude at the first channel 202 output from the sub-band suppression module 216 falls outside of the range of the amplifier being used to power the first speaker 226 and thus clipping may still occur. Accordingly, the soft clipping module 222 may be provided to soft clip the first channel 202 when its amplitude reaches the limits of operating range of the amplifier being used for the first channel 202.

Figure 6:
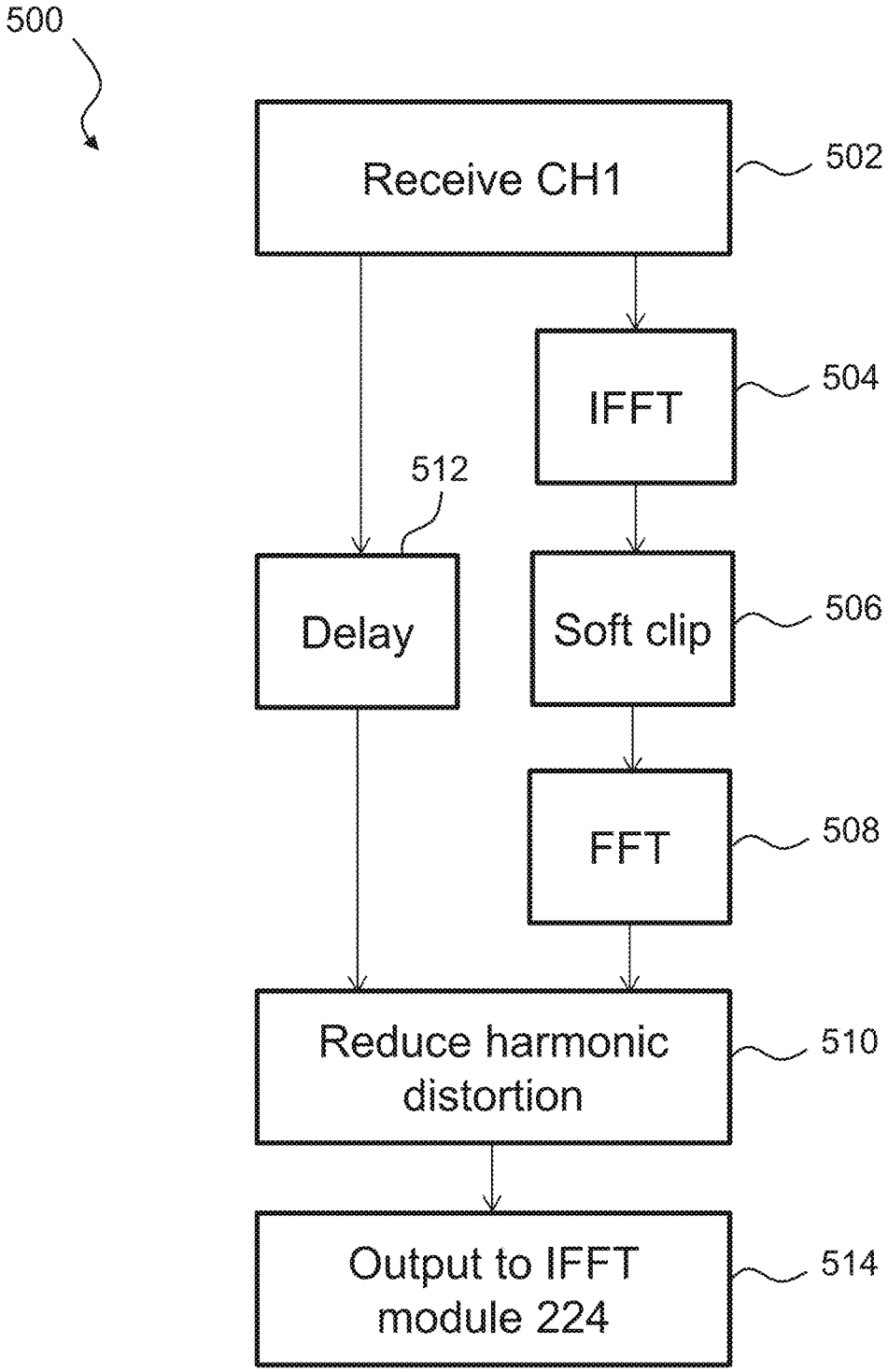
FIG. 6 is a flow diagram illustrating a process performed by the soft clipping module 222 shown in FIG. 2.

FIG. 6 illustrates an example process 500 performed by the soft clipping module 222. At step 502, the first channel 202 is received from the sub-band suppression module 216. At step 504, the first channel 202 is converted into the time domain, for example, using an inverse fast Fourier transform. The soft clipping module 222 then applies a soft clipping function to the first channel 202 in the time domain at step 506. The soft clipping module 222 may apply any known soft clipping function to the first channel 202. In some embodiments, the soft clipping module 222 may apply a sigmoid function.

Whilst the use of a static soft clipping function reduces harmonic distortion, a side effect of conventional Sigmoid-type soft-clipping is that the input signal is suppressed regardless of whether its peak amplitude is below or above the threshold. For example, when an input signal having a peak amplitude below the threshold amplitude is suppressed using a Sigmoid function, the maximum amplitude of the output signal is limited to 0.76 times the threshold, which is equivalent to a loss of 2.3 dB. Preferably, therefore, a dynamic soft clipping function is applied by the soft clipping module 222 to the first channel 202.

Figure 7:
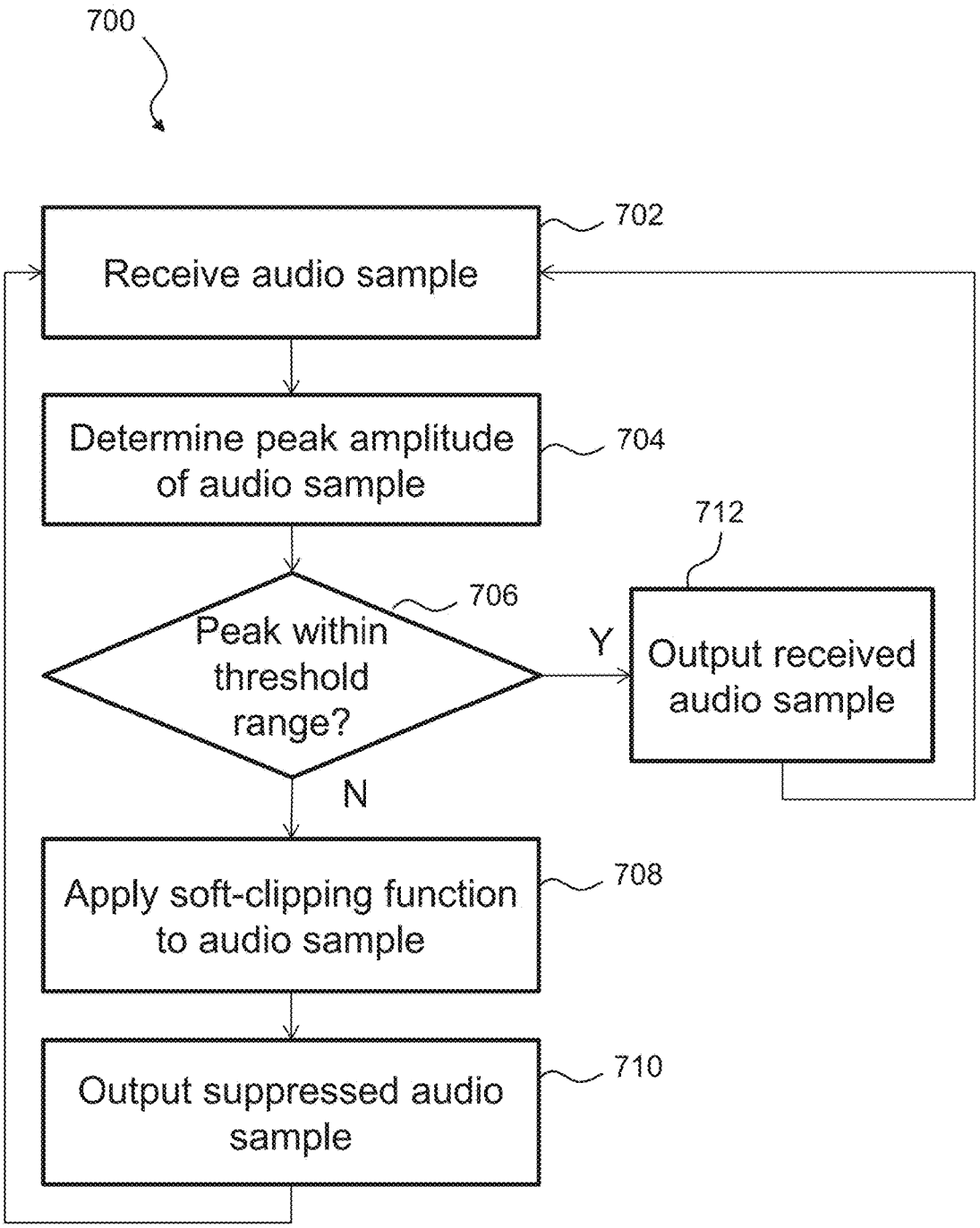
FIG. 7 is another flow diagram illustrating a process performed by the soft clipping module 222 shown in FIG. 2.

FIG. 7 is a flow diagram illustrating an exemplary process 700 undertaken by the clipping module 222. At step 702 the soft clipping module 222 receives a sample received from the IFFT 504. The peak amplitude of the sample is then determined at step 704 and at step 706 the determined peak amplitude is compared with a threshold range, which may be a predetermined range or a range determined dynamically, as will be described in more detail below.

If the peak amplitude of the audio sample is found to fall outside of the threshold range, then the process 700 continues to step 708. At step 708, the audio sample is suppressed using a soft-clipping function and the suppressed audio sample may then be output at step 710. The process 700 then returns to step 702 where the next received audio sample may be processed in a similar manner.

Returning to step 706, if the peak amplitude of the audio sample is found to fall within the threshold range or found to be equal to an upper or lower limit of the threshold range, then the process 700 continues to step 712, where the audio sample is output in its original, unsuppressed, form. The process 700 then returns to step 702 where the next received audio sample may be processed in a similar manner.

It will be appreciated that, in contrast to prior art soft-clipping techniques which suppress audio samples irrespective of their amplitude, the soft clipping module 222 applies suppression only to audio samples who's peak amplitude falls outside of the defined threshold range. As such, overall, signal power is maximised whilst minimizing harmonic distortion associated with conventional hard clipping.

As mentioned above, the threshold range may be predetermined or determined dynamically during operation. In any case, the threshold range may be determined based on one or more characteristics of the soft clipping module 222 or indeed the entire signal processing module 200. For example, the threshold range may be determined in dependence on the operating limits of the signal processing module 200 or any part thereof. In some embodiments, the threshold range may be chosen to be equal to a dynamic range of the signal processing module 200. In a digital system, the dynamic range or operating limits may be defined as ±1 or 0 dBFS.

The inventors have realised that any spectrum modifications made to the audio channel after processing by the clipping module 222 may change the crest factor of the signal which in turn may lead to an increase in the peak amplitude of samples in the audio channel. In doing so, if the threshold amplitude is set to be substantially equal to the dynamic range of the signal processing module, then the peak amplitude of the audio channel after further spectral modification may fall outside of the threshold range which it was previously adjusted to fall within.

Accordingly, in order to reduce the risk that any post processing leads to the peak amplitude (after post-processing) falling outside of the operating limits of signal processing module 200, the threshold range may be chosen to be a slightly smaller than the dynamic range (or operating limits) of the signal processing module 200. For example, the threshold range may be set at 0.5 dB inside of the full operating range of the system, i.e. ±0.95 or −0.5 dBFS. Providing a buffer either side of the threshold range to account for changes in crest factor associated with dynamic soft-clipping further acts to minimize the likelihood of hard clipping and associated harmonic distortion.

At step 708, suppressed signals falling outside of the threshold range may be processed using a conventional soft-clipping function. A soft-clipping function may be defined as a non-linear function which is strictly increasing. A function $f(x)$ is said to be strictly increasing on an interval I if $f(b)>f(a)$ for all $b>a$, where $a,b \in I$. In order to minimize harmonic distortion introduced by applying the soft-clipping function to the audio sample, the soft-clipping function is preferably also smooth over the threshold range. In other words, the soft-clipping function preferably has continuous derivatives over its entire range of operation, e.g. the threshold range. In some embodiments, the soft-clipping function is a Sigmoid function. A Sigmoid function may be defined as a bounded differential real function that is defined for all real input values and has a positive derivative at each point.

The relationship between the received audio sample in and the output audio sample out may be defined by the following equation, $$\text{out}=\alpha\cdot\text{in}+f(\text{in})\cdot(1-\alpha)$$

where $f$(in) is the soft-clipping function used to suppress the output and $\alpha$(alpha) is the suppression factor. For audio samples who's peak amplitude is found at step 706 to be within the threshold range, then the suppression factor alpha is set to 1. It follows that if the peak amplitude falls within the threshold range, then out=in and the audio sample is not suppressed. As mentioned above, this is in contrast with traditional soft-clipping approaches in which a soft-clipping function is applied to the audio sample regardless of whether the peak amplitude falls within or outside of the threshold range.

In some embodiments, for audio samples who's peak amplitude falls outside of the threshold range, the suppression factor may be defined by the following equation:

$$\alpha=\frac{T-T*f(P)}{P-T*f(P)}$$

where P is the peak amplitude of the audio sample, $f$(P) is the soft-clipping function solved for the peak amplitude P, and T is the magnitude of the upper or lower limit of the threshold range. Thus, the further the peak amplitude, P, falls outside of the threshold range, the smaller the value of alpha, which in turn increases both suppression of the received audio sample in and the weighting of the soft-clipping function (see relationship above).

Where T is chosen to be equal to the dynamic or operating range of the system 200, then T=1 and the above equation may be rewritten as:

$$\alpha=\frac{1-f(P)}{P-f(P)}$$

Where T is chosen to be, for example, 0.5 dB lower than the operating range of the system 200 so as to account for changes in crest factor due to processing of the output audio sample, then T=0.95 and the above equation may be rewritten as:

$$\alpha=\frac{0.95-0.95*f(P)}{P-0.95*f(P)}$$

It will be appreciated that rapid changes in the value of alpha may lead to artefacts in audible samples output from the soft-clipping module 222. To minimise such artefacts, in some embodiments, the rate of change of alpha may be limited to a predetermine threshold value. In particular, the rate of change of alpha may be limited when the level of the received sample is high, since the greater the amplitude of the audio channel, the greater the effect a change of alpha has on processed audio channel output from the clipping module 222. Equally, when the input audio signal amplitude is low, alpha may be changed rapidly since the value of alpha has little or no effect on the output at such low amplitudes.

To give enough time for alpha to change between samples having regard for the above discussion concerning minimising audible artefacts in the output, the clipping module 222 may "look ahead" at samples in the received audio channel which have yet to be processed to determine a peak amplitude of those signals such that alpha can be determined in advance. For example, if the frequency of received audio signal is above 500 Hz, the clipping module 222 may look ahead at samples 1 ms in advance, thereby ensuring at least one zero-crossing of the input signal during that 1 ms time frame. The clipping module 222 may then quickly adjust alpha during or close to the zero-crossing of the input signal, thereby minimising the impact of changing alpha on the quality of samples output.

Figure 8:
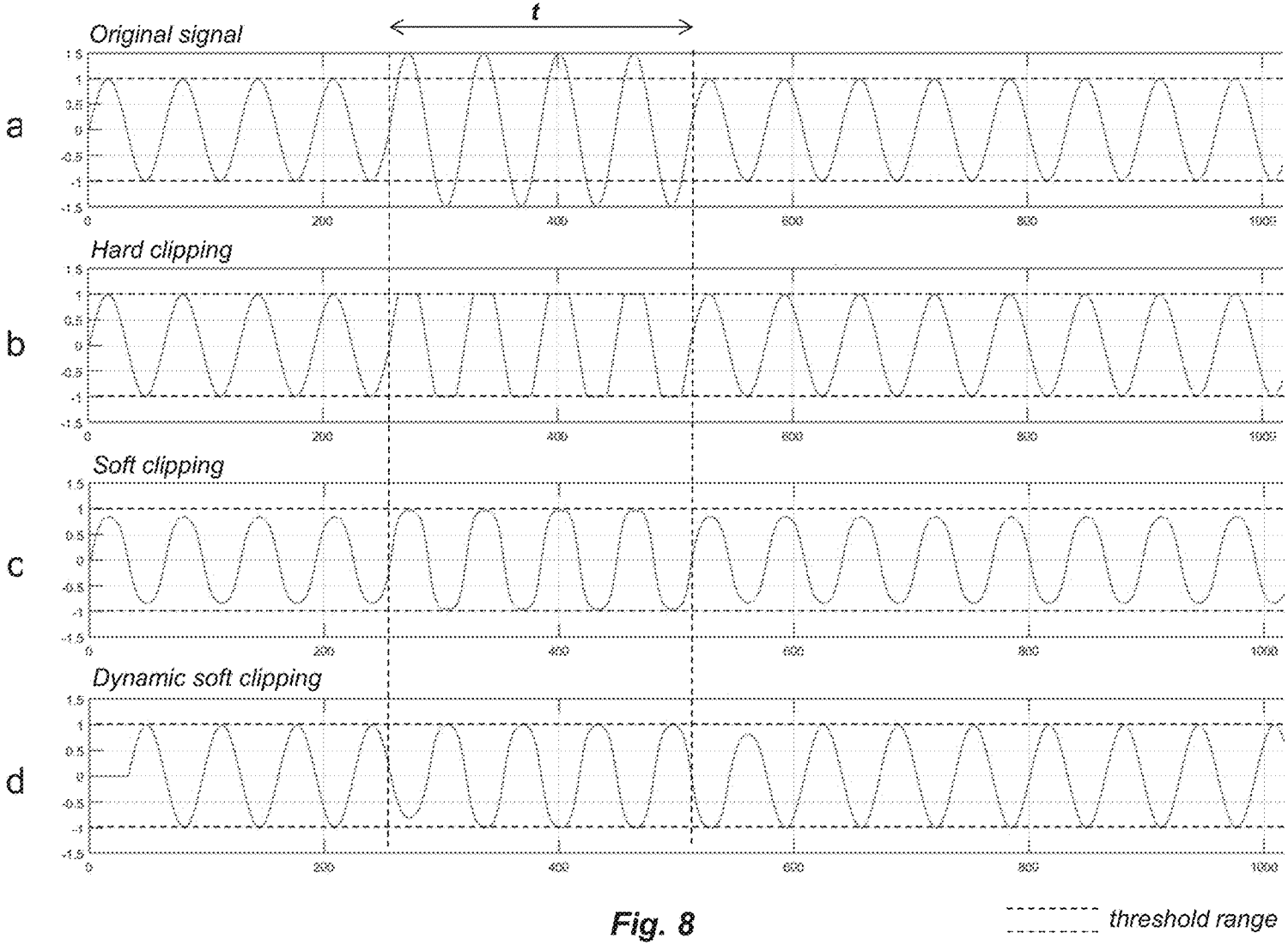
FIG. 8 is a graphical illustration of the comparative waveforms produced from various methods of clipping a sinusoidal input signal.

FIG. 8 graphically illustrates the output waveforms resultant from the processing of a sinusoidal input signal a) using b) conventional hard clipping; c) conventional soft-clipping using a Sigmoid function; and d) dynamic soft-clipping in accordance with embodiments of the present disclosure. In each plot, the threshold range is marked with horizontal dashed lines. Referring first to FIG. 8*a*, the sinusoidal input signal exceeds the threshold range for a time period t, either side of which the input signal is within the threshold range. FIG. 8*b* shows clipping of the signal to the upper and lower bounds of the threshold range. It can be seen that waveform is significantly distorted from the original input signal, the clipped signal resembling a square wave as opposed to the original sinusoid. FIG. 8*c* shows a conventionally soft-clipped signal. It can be seen that for the time period t, the soft-clipped waveform bares a similar resemblance to the original signal and falls within the threshold range. However, either side of the time period t, the amplitude of the soft-clipped signal is suppressed relative to the original input signal. FIG. 8*d* shows an exemplary dynamically soft-clipped signal processed in accordance with embodiments of the present disclosure. It can be seen that, like the conventionally soft-clipped signal shown in FIG. 8*c* during the time period t the waveform exhibits a similar resemblance to the original input waveform. However, in contrast to the conventionally soft-clipped signal, the waveform of the dynamically soft-clipped signal spans the entire threshold range either side of the period t, since no suppression is applied to the input signal during these time periods.

It is noted that in FIG. 8*d*, the lower peak of the waveform directly before time period t and the upper peak of the waveform directly after time period t appear suppressed. This is due to the samples/frames used to process the input signal spanning one peak falling within the threshold range and one peak falling outside of the threshold range.

It is also noted that in FIG. 8*d* a minor delay has been introduced by the dynamic soft-clipping approach, due to the soft clipping module 222 looking ahead to determine the threshold value in advance so that alpha can be changed during or close to zero crossovers in the audio signal (as explained above).

Referring again to FIG. 6, whether a static or dynamic soft clipping function is applied to the first channel 202 received at the soft clipping module 222, any such function will introduce harmonic distortion. Accordingly, the soft clipping module 222 preferably applies a noise reduction algorithm to the soft clipped first channel to reduce artefacts introduced by harmonic distortion. To do so, the first channel 202 is converted back into the frequency domain at step 508 and at step 510 a noise reduction algorithm is applied to the first channel.

In some embodiments, a Weiner filter is be used to reduce artefacts introduced by soft clipping. The sub-band gain G may be calculated using the following equation:

$$G = \frac{S}{S+N}$$

where S is the sub-band power before soft clipping and N is the harmonic distortion caused by soft clipping. In order to apply the Weiner filter, at step 512, delay is applied to the original first channel 202 received at step 502 and the delayed first channel 202 is also used at step 510 to perform the harmonic distortion reduction.

After reducing harmonic distortion at step 510 the processed signal is output from the soft clipping module 216 to the IFFT module 224 at step 514.

It will be appreciated that one or more of the weighting factors used to determine an importance weighting for each of the sub-bands in the first channel 202 may be used to determine whether the distortion introduced by soft-clipping will be audible in the final stereo output. For example, if distortion in a sub-band is masked by the remainder of the first channel 202 or the second channel 204, then noise reduction need not be applied to that sub-band.

Figure 9:
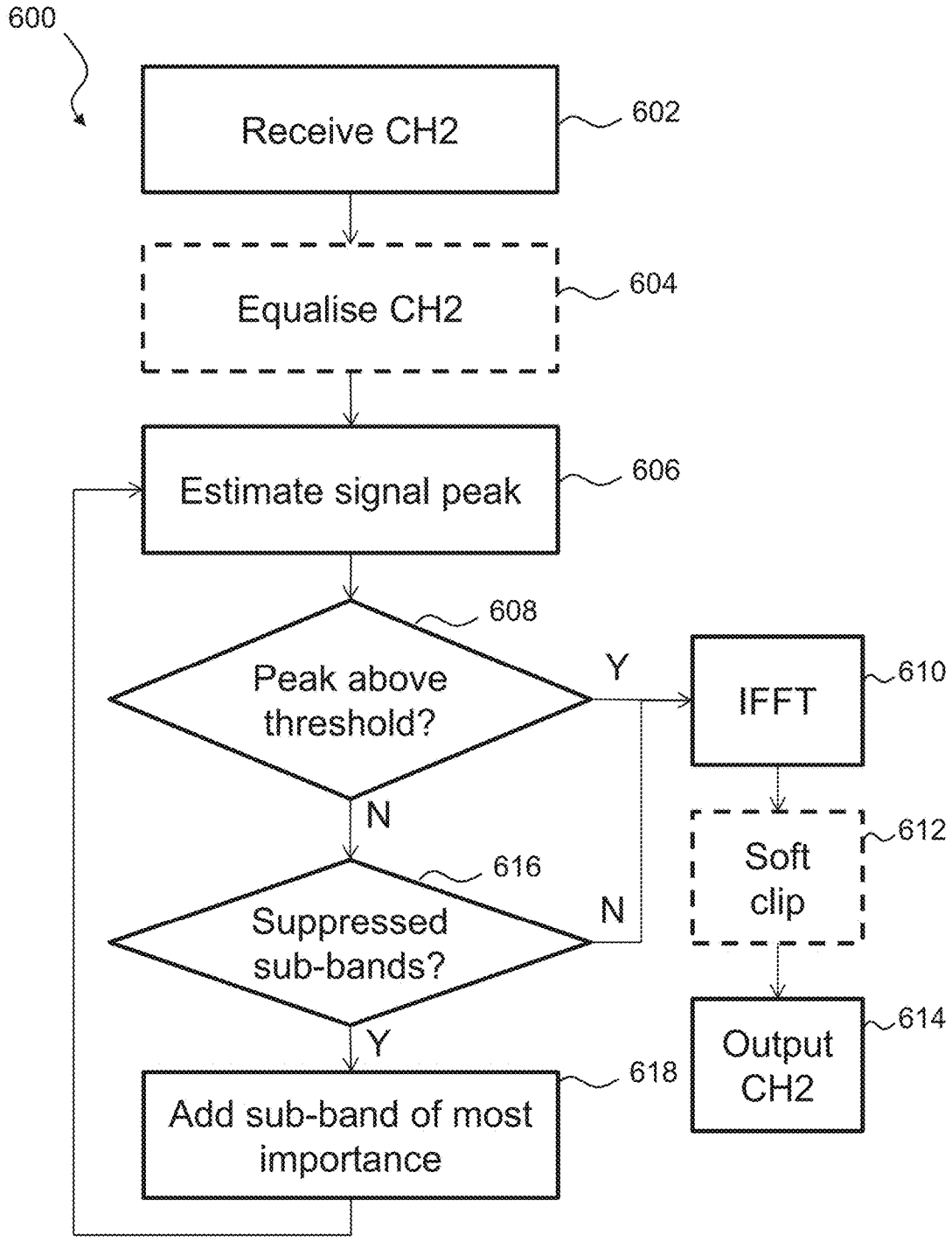
FIG. 9 is a flow diagram of a process performed by the channel 2 processing module shown in FIG. 2.

As mentioned above, referring back to FIG. 2, the second audio channel 204 preferably also undergoes processing at the channel 2 processing module 230 before being output to the second speaker 228. FIG. 9 illustrates an exemplary process 600 performed by the channel 2 processing module 230. At step 602, channel 2 processing module 230 receives the second channel 204. Optionally, at step 604, the second channel 204 is equalised to take into account the frequency response of the second speaker 228 to which the second channel 204 is to be output. Equalisation at step 602 may also comprise adjusting the levels of the second channel 204 to match the loudness of the output at the second speaker 228 with that at the first speaker 226. Such loudness matching may be omitted, for example, if the first channel 202 has already been compensated during equalisation at step 404 described above with reference to FIG. 4.

After the second channel 204 has been equalised, at step 606, an estimated peak amplitude of the second channel 204 is calculated. The peak amplitude of the second channel 204 may be estimated using similar techniques to those discussed above with reference to the first channel 202.

The estimated peak amplitude calculated at step 606 is then compared, at step 608, to a peak threshold value. The peak threshold value may be set so as to minimise the chance of clipping of the second channel 204. In doing so, any harmonic distortion introduced by subsequent soft clipping of the second channel 204 (if performed) will be minimal relative to that associated with the first channel 202.

If it is found at step 608 that the estimated signal peak is above the peak threshold value, then at step 610 the second channel 204 may be converted without any modification (i.e. with no sub-band additions) into the time domain, optionally soft clipped at step 612, and output at step 616 to the second speaker 228. It will be appreciate that soft clipping at step 612 may performed in a manner similar to that performed in respect of the first channel 202 as described above. Since the peak threshold value is set at step 608 to minimise clipping of the second channel 204 such that minimal harmonic distortion is introduced during soft clipping at step 612, harmonic distortion correction, as described above with reference to the first channel 202, should not be required for the second channel 204.

If it is found at step 608 that the estimated signal peak is below the peak threshold value, then at step 616 the channel 2 processing module 230 determines whether any sub-bands were suppressed in the first channel 612 by the sub-band suppression module 216. If no sub-bands were suppressed, then the process 600 returns to step 610 where the second channel 204 is converted into the time domain, optionally soft clipped at step 612, and output to the second speaker 228 without any modification (i.e. with no sub-band additions).

If it is determined that sub-band suppression was performed, then the process continues to step 618 where the channel 2 processing module 230 adds to the second channel 204 the last sub-band signal which was removed from the first channel 202 by the sub-band suppression module 216 (i.e. the sub-band suppressed in the first channel 202 which was of most importance is added to the second channel). The process 600 may then return to step 404 where the second channel 204 is again equalised before calculation of signal peak of the first channel 202 is repeated at step 406, this time having one or more sub-band signals from the first channel 202 added. Steps 608, 616, 618, 604 and 606 are then repeated until the estimated signal peak of the second channel 204 increases to above the peak threshold value, at which point the processes continues to step 610 as described above.

The module 200 or any modules thereof may be implemented in firmware and/or software. If implemented in firmware and/or software, the functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray® discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

It should be noted that the above-mentioned embodiments illustrate rather than limit the invention, and that those skilled in the art will be able to design many alternative embodiments without departing from the scope of the appended claims. The present embodiments are, therefore, to be considered in all respects as illustrative and not restrictive. The word "a" or "an" does not exclude a plurality, and a single feature or other unit may fulfil the functions of several units recited in the claims. Additionally the term "gain" does not exclude "attenuation" and vice-versa. Any reference numerals or labels in the claims shall not be construed so as to limit their scope.

The invention claimed is:

1. A method of processing stereophonic audio content received in a first audio channel and a second audio channel, the first audio channel to be output to a first speaker and the second audio channel to be output to a second speaker, the method comprising:

receiving the first and second audio channels;

identifying a plurality of frequency sub-bands in the first audio channel;

for each of the plurality of frequency sub-bands, determining an importance weighting based on an estimated degree of audibility of the sub-band in the first audio channel when the first and second audio channels are output to the first and second speakers;

in response to determining that a peak amplitude of the first audio channel is above a first clipping threshold, iteratively suppressing the sub-band of least importance in the first audio channel until the peak amplitude of the first audio channel is below the first clipping threshold; and outputting the suppressed first audio channel.

2. The method of claim 1, wherein determining the importance weighting for each of the first plurality of frequency sub-bands comprises:

comparing each sub-band with the remainder of the first audio channel and/or the second audio channel; and determining an amount of auditory masking of the sub-band based on the comparison.

3. The method of claim 2, wherein the importance weighting decreases as the level of auditory masking for the sub-band increases.

4. The method of claim 1, wherein determining the importance weighting for each of the first plurality of frequency sub-bands comprises:

comparing an amplitude of each sub-band with an amplitude of a corresponding sub-band in the second audio channel; and increasing the importance weighting if the amplitude of the sub-band in the first audio channel is greater than the amplitude of corresponding sub-band in the second audio channel.

5. The method of claim 1, wherein the importance weighting is determined based on an estimated sensitivity of a human ear in the frequency range of the sub-band.

6. The method of claim 5, wherein the sensitivity of the human ear is estimated using an ITU-R 468 noise weighting curve, an inverse equal-loudness contour, or an A-weighting curve.

7. The method of claim 1, wherein the importance weighting is determined based on a frequency response of the first speaker in the frequency range of the sub-band.

8. The method of claim 7, wherein the importance weighting is determined based on the difference in frequency response between the first speaker and the second speaker in the frequency range of the sub-band.

9. The method of claim 7, wherein the importance weighting is determined based on a speaker efficiency index $W_m$ defined by:

$$W_m=(1/1+b^2);\ b=FR_{SP2}/FR_{SP1}$$

where $FR_{SP1}$ is the frequency response of the first speaker and $FR_{SP2}$ is the frequency response of the second speaker.

10. The method of claim 1, wherein the plurality of frequency sub-bands are identified using the Bark scale.

11. The method of claim 1, further comprising:

before determining that the peak amplitude of the first audio channel is above the first clipping threshold, equalising the first audio channel based on the frequency response of the first speaker.

12. The method of claim 1, further comprising:

equalising the second audio channel based on the frequency response of the second speaker.

13. The method of claim 1, further comprising:

adding suppressed sub-bands in the first audio channel to the second audio channel.

14. The method of claim 13, wherein the suppressed sub-bands in the first audio channel are iteratively added in order of importance based on the importance weighting until a peak amplitude of the second audio channel exceeds a second clipping threshold.

15. The method of claim 1, further comprising soft clipping the suppressed first audio channel.

16. The method of claim 15, wherein soft clipping the suppressed first audio channel comprises:

receiving an audio sample of the suppressed first audio channel;

on determining that a peak amplitude of the audio sample falls outside a threshold range:

suppressing the audio sample to within the threshold range by applying a strictly increasing non-linear function to the audio sample; and outputting the suppressed audio sample; and on determining that the peak amplitude of the audio sample falls within the threshold range or is equal to an upper or lower limit of the threshold range:

outputting the received audio sample.

17. The method of claim 16, wherein a level of suppression of the audio sample is proportional to the difference between the peak amplitude of the audio sample and the upper or lower limit of the threshold range.

18. The method of claim 16, wherein the strictly increasing non-linear function is smooth within the threshold range.

19. The method of claim 16, wherein suppression of the audio sample comprises reducing the peak amplitude to within +/−0.95 times the threshold range.

20. The method of claim 16, wherein determining that a peak amplitude of the audio sample falls outside of the threshold range comprises:

determining a suppression factor $\alpha$ proportional to the peak amplitude of the audio sample, wherein the non-linear function is weighted by the suppression factor.

21. The method of claim 20, wherein a delay is provided between determining the suppression factor and suppressing the audio sample.

22. The method of claim 20, wherein, on determining that a peak amplitude of the audio sample falls outside a threshold range, the suppression factor $\alpha$ is defined by the equation:

$$\alpha = \frac{T - T * f(P)}{P - T * f(P)}$$

where:

P is the peak amplitude of the audio sample;

$f(P)$ is the non-linear function solved for the peak amplitude P; and

T is the upper limit of the threshold range.

23. The method of any one of claim 20, wherein, on determining that the peak amplitude of the audio sample falls within the threshold range or is equal to an upper or lower limit of the threshold range, the suppression factor $\alpha$ is equal to 1.

24. The method of claim 22, wherein the relationship between the received audio sample in and the output suppressed audio sample or the output received audio signal out is defined as:

$$out=\alpha\cdot in+f(in)\cdot(1-\alpha)$$

where:

out is the output suppressed audio signal or the output received audio signal;

in is the received audio signal; and $f(in)$ is the non-linear function.

25. The method of claim 16, wherein the non-linear function $f(in)$ comprises a sigmoid function.

26. The method of claim 25, wherein the non-linear function $f(in)$ comprises a function defined by the equation:

$$f(in) = \mathrm{erf}\left(\frac{\sqrt[2]{\pi}}{2} in\right)$$

where in is the received audio sample.

27. The method of claim 16, wherein the non-linear function is a polynomial function.

28. The method of claim 16, further comprising applying a Wiener filter to the suppressed audio sample.

29. The method of claim 16, further comprising iteratively repeating the method of claim 16 for one or more additional audio samples in the suppressed first audio channel.

30. An apparatus for processing stereophonic audio content received in a first audio channel to be output to a first speaker and a second audio channel to be output to a second speaker, the apparatus comprising:

an input for receiving the first and second audio channels; and one or more processors configured to:

identify a plurality of frequency sub-bands in the first audio channel;

for each of the plurality of frequency sub-bands, determine an importance weighting based on a degree of audibility of the sub-band when combined with the remainder of sub-bands of the first audio channel and the second audio channel;

on determining that a peak amplitude of the first audio channel is above a first clipping threshold, iteratively suppress the sub-band of least importance in the first audio channel until the peak amplitude of the first audio channel is below the first clipping threshold; and an output for outputting the suppressed first audio channel.

31. The apparatus of claim 30, wherein determining the importance weighting for each of the first plurality of frequency sub-bands comprises:

comparing each sub-band with the remainder of the first audio channel and/or the second audio channel; and determining an amount of auditory masking of the sub-band based on the comparison.

32. The apparatus of claim 31, wherein the importance weighting decreases as the level of auditory masking for the sub-band increases.

33. The apparatus of claim 30, wherein determining the importance weighting for each of the first plurality of frequency sub-bands comprises:

comparing an amplitude of each sub-band with an amplitude of a corresponding sub-band in the second audio channel; and increasing the importance weighting if the amplitude of the sub-band in the first audio channel is greater than the amplitude of corresponding sub-band in the second audio channel.

34. The apparatus of claim 30, wherein the importance weighting is determined based on an estimated sensitivity of a human ear in the frequency range of the sub-band.

35. The apparatus of claim 34, wherein the sensitivity of the human ear is estimated using an ITU-R 468 noise weighting curve, an inverse equal-loudness contour, or an A-weighting curve.

36. The apparatus of claim 30, wherein the importance weighting is determined based on a frequency response of the first speaker in the frequency range of the sub-band.

37. The apparatus of claim 36, wherein the importance weighting is determined based on the difference in frequency response between the first speaker and the second speaker in the frequency range of the sub-band.

38. The apparatus of claim 36, wherein the importance weighting is determined based on a speaker efficiency index $W_m$ defined by:

$$W_m=(1/1+b^2);\ b=FR_{SP2}/FR_{SP1}$$

where $FR_{SP1}$ is the frequency response of the first speaker and $FR_{SP1}$ is the frequency response of the second speaker.

39. The apparatus of claim 30, wherein the plurality of frequency sub-bands are identified using the Bark scale.

40. The apparatus of claim 30, wherein the one or more processors are further configured to:

before determining that the peak amplitude of the first audio channel is above the first clipping threshold, equalise the first audio channel based on the frequency response of the first speaker.

41. The apparatus of claim 30, wherein the one or more processors are further configured to:

equalise the second audio channel based on the frequency response of the second speaker.

42. The apparatus of claim 30, wherein the one or more processors are further configured to:

add suppressed sub-bands in the first audio channel to the second audio channel.

43. The apparatus of claim 42, wherein the suppressed sub-bands in the first audio channel are iteratively added in order of importance based on the importance weighting until a peak amplitude of the second audio channel exceeds a second clipping threshold.

44. The apparatus of claim 30, wherein the one or more processors are further configured to soft clip the suppressed first audio channel.

45. The apparatus of claim 44, wherein soft clipping the suppressed first audio channel comprises:

receiving an audio sample of the suppressed first audio channel;

on determining that a peak amplitude of the audio sample falls outside a threshold range:

suppressing the audio sample to within the threshold range by applying a strictly increasing non-linear function to the audio sample; and outputting the suppressed audio sample; and on determining that the peak amplitude of the audio sample falls within the threshold range or is equal to an upper or lower limit of the threshold range:

outputting the received audio sample.

46. The apparatus of claim 45, wherein a level of suppression of the audio sample is proportional to the difference between the peak amplitude of the audio sample and the upper or lower limit of the threshold range.

47. The apparatus of claim 45, wherein the strictly increasing non-linear function is smooth within the threshold range.

48. The apparatus of claim 45, wherein suppression of the audio sample comprises reducing the peak amplitude to within +/−0.95 times the threshold range.

49. The apparatus of claim 45, wherein determining that a peak amplitude of the audio sample falls outside of the threshold range comprises:

determining a suppression factor α proportional to the peak amplitude of the audio sample, wherein the non-linear function is weighted by the suppression factor.

50. The apparatus of claim 49, wherein a delay is provided between determining the suppression factor and suppressing the audio sample.

51. The apparatus of claim 49, wherein, on determining that a peak amplitude of the audio sample falls outside a threshold range, the suppression factor α is defined by the equation:

$$\alpha = \frac{T - T * f(P)}{P - T * f(P)}$$

where:

P is the peak amplitude of the audio sample;

ƒ(P) is the non-linear function solved for the peak amplitude P; and

T is the upper limit of the threshold range.

52. The apparatus of claim 49, wherein, on determining that the peak amplitude of the audio sample falls within the threshold range or is equal to an upper or lower limit of the threshold range, the suppression factor α is equal to 1.

53. The apparatus of claim 52, wherein the relationship between the received audio sample in and the output suppressed audio sample or the output received audio signal out is defined as:

$$out = \alpha \cdot in + f(in) \cdot (1 - \alpha)$$

where:

out is the output suppressed audio signal or the output received audio signal;

in is the received audio signal; and

ƒ(in) is the non-linear function.

54. The apparatus of claim 45, wherein the non-linear function ƒ(in) comprises a sigmoid function.

55. The apparatus of claim 54, wherein the non-linear function ƒ(in) comprises a function defined by the equation:

$$f(in) = \mathrm{erf}\left(\frac{\sqrt[2]{\pi}}{2} in\right)$$

where in is the received audio sample.

56. The apparatus of claim 53, wherein the non-linear function is a polynomial function.

57. The apparatus of claim 45, further comprising applying a Wiener filter to the suppressed audio sample.

58. The apparatus of claim 45, further comprising iteratively repeating the method of claim 45 for one or more additional audio samples in the suppressed first audio channel.

59. An electronic device comprising an apparatus according to claim 45.

60. The electronic device of claim 59, wherein the electronic device is: a mobile phone, a media playback device, or a mobile computing platform.

* * * * *